US006144302A

United States Patent [19]

Cotty, Jr. et al.

[11] Patent Number: 6,144,302

[45] Date of Patent: Nov. 7, 2000

[54] EMERGENCY WORKER PROTECTION APPARATUS AND METHOD

[75] Inventors: Glenn Martin Cotty, Jr., Pearl River; Glen Clyden Argabright, Metairie, both of La.

[73] Assignee: Lockheed Martin Corporation, New Orleans, La.

[21] Appl. No.: 09/065,400

[22] Filed: Apr. 24, 1998

[51] Int. Cl.[7] ..... G08B 23/00

[52] U.S. Cl. ..... 340/573.1; 116/18; 116/202; 362/259

[58] Field of Search ..... 340/573.1, 691.1; 116/18, 202; 362/540, 543, 164, 166, 197, 208, 236, 259

[56] References Cited

U.S. PATENT DOCUMENTS

| | | | |
|---|---|---|---|
| 4,090,185 | 5/1978 | Patty | 340/321 |
| 4,649,376 | 3/1987 | Frank | 340/691 |
| 4,945,458 | 7/1990 | Batts et al. | 362/106 |
| 5,329,637 | 7/1994 | Walker | 2/5 |
| 5,541,579 | 7/1996 | Kiernan | 340/573.1 |
| 5,847,651 | 12/1998 | Lu | 340/573.1 |

*Primary Examiner*—Jeffery A. Hofsass
*Assistant Examiner*—Toan Pham
*Attorney, Agent, or Firm*—W. H. Meise; T. G. Fierke

[57] ABSTRACT

A garment or apparatus worn by emergency workers includes an electrically operated source of multiple, mutually diverging laser light beams. The light beams may be modulated to identify the worker and his status. The worker's location in an emergency environment is readily established as the locus of the diverging beams. A smoke-filled environment makes the laser beams more visible to rescuers.

13 Claims, 6 Drawing Sheets

EMERGENCY WORKER PROTECTION APPARATUS AND METHOD

FIELD OF THE INVENTION

This invention relates to apparatus and methods for protection of personnel entering an emergency location, and more particularly to a system of mutually diverging light beams carried by the person so entering.

BACKGROUND OF THE INVENTION

When emergency personnel such as firemen enter an emergency location, they are often faced with dangerous conditions, such as open flames, smoke, toxic gases, and the like. which may, on occasion, lead to incapacity of one or more of the emergency workers or people. In the case of a fire location, the incapacity of a person in the region of the fire may be life-threatening. Incapacity of a person in such an emergency location is often accompanied by unconsciousness, and therefore by an inability of the worker to either extricate himself from the location, or even to communicate his plight to rescue workers. Even if incapacity does not result in unconsciousness, the emergency worker may be disoriented by loss of sensory information due in part to the environment, which may be dark, smoke-filled, and subject to falling debris and open flame, and also due in part to the nature of the emergency equipment which is used, which may include heavy air tanks, respirators or masks which prevent effective use of the sense of smell, goggles which, together with environmental smoke or haze, and flares of flame, impair eyesight, and gloves which reduce the sensation of touch.

If the emergency worker who is incapacitated does not respond to communications, his incapacity may be realized early by other workers at the site, or his incapacity may be inferred by his failure to exit the site after a period of time. In either case, the incapacitated worker must be found and extricated from the emergency area. The same effects which caused the initial disorientation or incapacity of the worker being sought also apply to those seeking his rescue. It is vital, for the safety of the incapacitated worker and of his rescuers, that he be located promptly. It has been found that focussed Xenon-halogen flashlights can penetrate a reasonable distance in a smoky atmosphere, but reflections from smoke particles create a bloom which results in partially blinding the user, as the use of high beams in fog tends to reduce the contrast of the scene relative to low beams. Recovery of the dark-adapted eye from an exposure to bright white light has been shown to take up to several minutes.

SUMMARY OF THE INVENTION

A method for protecting emergency personnel includes the step of affixing to each emergency worker a source of multiple, mutually diverging, preferably collimated, light beams. These light beams perforce diverge away from each other and from the emergency worker. The worker also bears a source of energization which is electrically coupled to the source of multiple beams of light. Before the emergency worker enters an emergency location, the source of multiple beams of light is connected to the source of energization, for thereby generating the multiple beams of light. During the course of the emergency operation the location of each emergency worker can be established by any other worker as being at the confluence of the diverging beams of light. Knowledge of the location of co-workers is critically important in the event that one emergency worker should become incapacitated. The beams of light, and their confluence, is especially visible in a smoky or hazy atmosphere. The step of connecting the source includes the step of connecting the source of multiple beams of light to the source of energization by way of an automatic pulse generating arrangement, for energizing and deenergizing at least a portion of the source of multiple beams, for thereby causing at least one of the multiple beams to pulsate. The pulsation makes the beam easier to see. According to another aspect of the invention, the step of connecting the source includes the step of connecting the source of multiple beams of light to the source of energization by way of an automatic pulse generating arrangement, for sequentially energizing and deenergizing at least a portion of the source of multiple beams, for thereby causing at least one of the multiple beams to pulsate.

In a preferred embodiment of the invention, the step of connecting the source of multiple beams of light to the source of energization by way of an automatic pulse generating arrangement includes the step of connecting the source of multiple beams of light to the source of energization by way of an automatic pulse generating arrangement which sequentially energizes and deenergizes that portion of the source of multiple beams in a fashion which modulates at least one of the multiple beams with one of a first selected code and a second selected code. This allows the person or emergency worker bearing the source of multiple beams to, after entering the emergency location, changing the one of the codes to the other one of the codes , to thereby transmit over the at least one (and preferably all) of the light beams an indication of a change in the state of the emergency worker.

The step of affixing to each emergency worker a source of multiple beams of light may include the step of affixing a holder for multiple lasers to an article capable of being worn by the emergency worker, such as a protective garment, helmet, or breathing apparatus. A source of energization is then affixed to the article capable of being worn, or possibly to some other donnable article. The step of affixing a source of multiple light beams and the step of affixing a source of energization may be combined into a single step when the source of multiple light beams and the source of energization are inseparable from each other, as being contained in a single apparatus. The emergency worker is then caused to don the article capable of being worn, and the multiple lasers are electrically connected to the source of energization.

An apparatus for aiding in performing the method of the invention includes a donnable article of apparel, an electrically actuated source of mutually diverging beams of light, which produces light beams which are preferably collimated, mounted on the article of apparel, with the light beams directed outwardly, a source of electrical energy mounted on the article of apparel, and an electrical connection arrangement coupled to the source of mutually diverging beams and the source of electrical energy, for electrically connecting the source of mutually diverging beams to the source of electrical energy in a manner which results in electrical energization of the source of mutually diverging beams. The electrical connection arrangement preferably includes a manually operated switch, and a coding arrangement for imparting a selectable one of a plurality of codes to electricity traversing the electrical connection arrangement, for thereby imparting one of the plurality of codes to the mutually diverging beams. The apparatus should also include an emergency button or switch which is operable by the emergency worker to cause the code to change in the event of a personal emergency of that worker.

DESCRIPTION OF THE INVENTION

Figure 1:
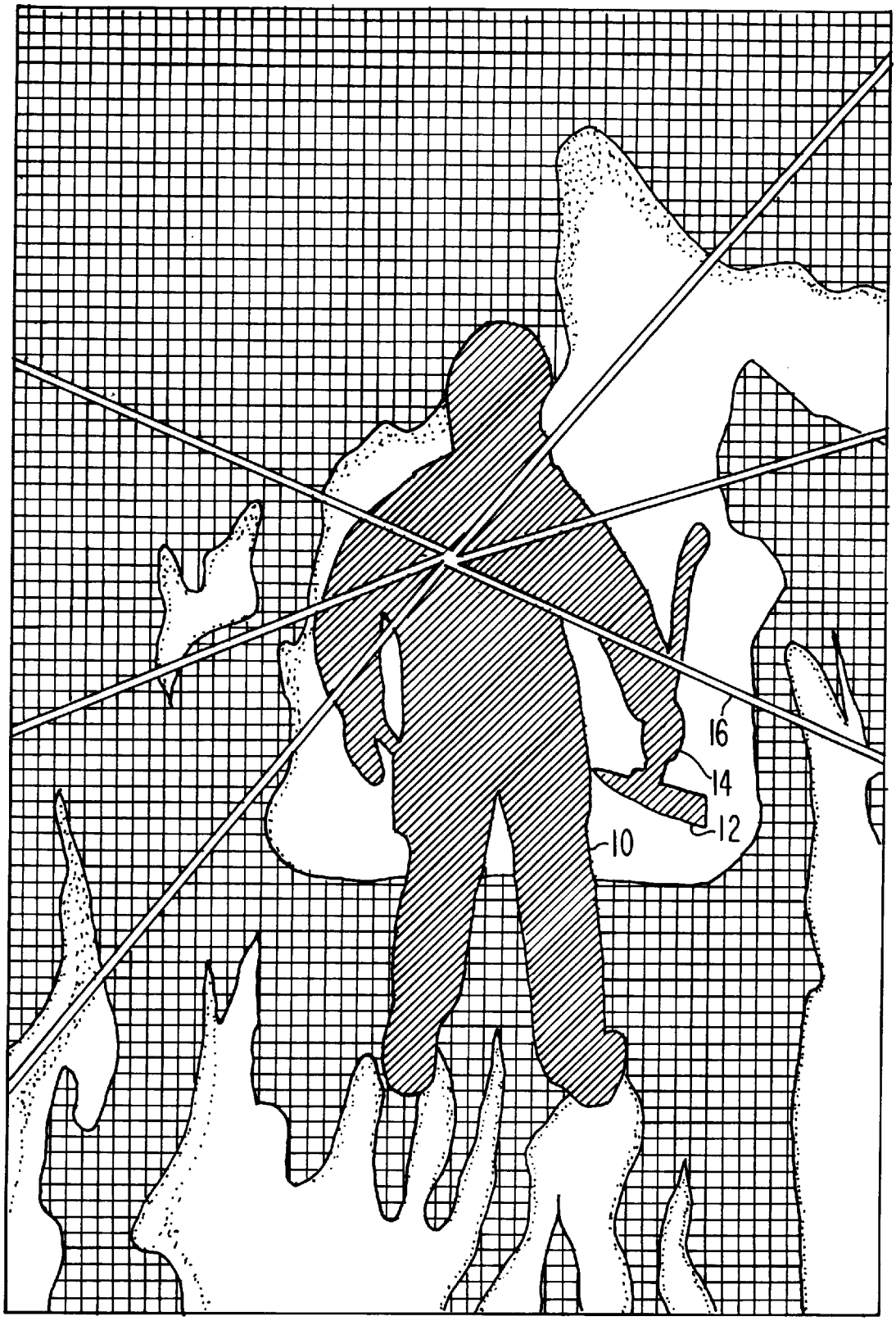
FIG. 1 illustrates an emergency worker in an emergency location, with the worker bearing an locating apparatus according to an aspect of the invention.

In FIG. 1, an emergency location is dark, hazy, and has open flames. An emergency worker designated as 10 is outlined in an indistinct fashion, in part because of the environmental conditions, and in part because his emergency equipment surrounds him and has no prominent features. The worker can, however, be seen to be carrying an axe 12 in his left hand 14 (if the worker is facing the viewer, or his right hand if the worker faces away). Also illustrated in FIG. 1 are a number, illustrated as six, of bright light beams, a representative one of which is designated as 16, which penetrate the smoke and haze. The light beams 16 are rendered visible by the haze or smoke of the environment, and the mutual beam divergence results in the appearance to a viewer that the multiple beams converge at a particular location on the worker, or more to the point, at the worker himself. If the worker were to become disoriented or disabled, his location would be easy to determine so long as one or more of the light beams were visible. Diffusion of even a single beam attributable to airborne particles creates an exaggerated apparent beam divergence that gives a visual perception of the direction of propagation of the light beam, and therefore indicates which end is the source end. Also, the angle relative to vertical of the visible beam(s) also provides an indication of the probable source, because the incapacitated worker will most often be at a relatively low position, as on the floor. These additional indicia are considered to be important to the workers, because under the most severe conditions of dense smoke, only one of the light beams may be visible.

The environment illustrated in FIG. 1 is dark, and the emergency workers should have their eyes adapted to the relatively low light level. It is desirable that the light beams 16 of FIG. 1 be of a color which does not excessively interfere with dark adaptation of the eye; red in the range of 670 to 630 nm is preferred for this reason.

Figure 2A:
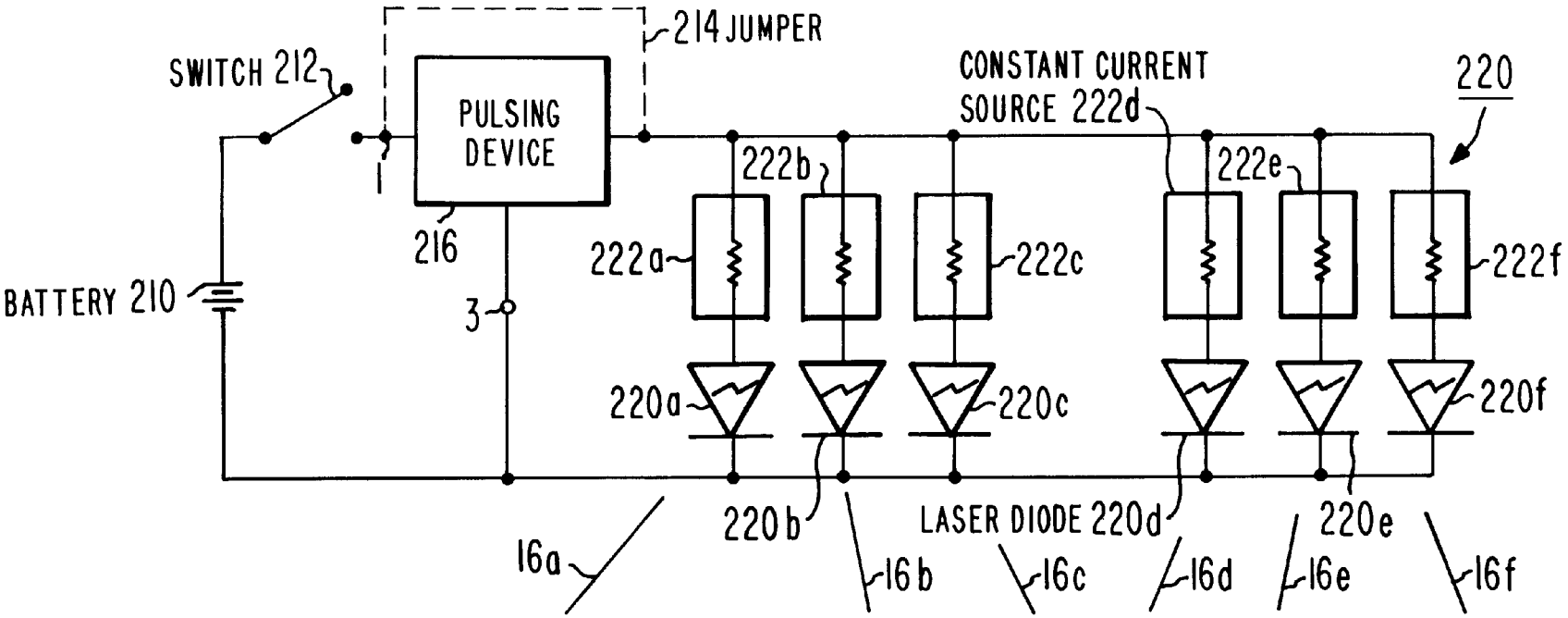
FIG. 2*a* is a simplified diagram in block and schematic form which illustrates the electrical connections of an embodiment of the invention.

In apparatus 200 of FIG. 2*a*, a source of electrical energy, illustrated as a battery 210, is connected by way of a manually operable switch 212 to a terminal 1, and, by way of either a direct connection path illustrated as jumper 214 or a coding control circuit illustrated as a block 216, to a terminal 2 and an array 220 of light sources illustrated by diode symbols 220*a*, 220*b*, 220*c*, 220*d*, 220*e*, and 220*f*. The light sources illustrated by diode symbols may be solid-state devices known as light-emitting diodes, or they may be solid-state lasers. The conduction curves of both solid-state light-emitting diodes (LEDs) and laser diodes are such that they may draw excessive current if connected directly across a voltage source, so it is common practice to connect multiple LEDs in series, together with a series resistor to limit the LED voltage over a wide range of applied voltages, while common practice for laser diodes is to use an active current regulator in series with each diode. If the light sources illustrated by diode symbols 220*a*, 220*b*, 220*c*, 220*d*, 220*e*, and 220*f* are laser diodes, each is connected in series with a suitable active current regulator. More particularly, laser diode 220*a* is connected in series with current regulator 222*a*, laser diode 220*b* is connected in series with current regulator 222*b*, laser diode 220*c* is connected in series with current regulator 222*c*, laser diode 220*d* is connected in series with current regulator 222*d*, laser diode 220*e* is connected in series with current regulator 222*e*, and laser diode 220*f* is connected in series with current regulator 222*f*. It should be noted that solid-state laser diodes are ordinarily supplied with built-in current regulators, but they are illustrated separately in FIG. 2*a*. The series combinations of laser diode and current regulator are connected in parallel across the voltage bus connected to terminal 2. Each light source of array 220 emits its own separate beam of light 16. As a more specific illustration, that light beam emitted by light source 220*a* is designated 16*a*. The light beams emitted by sources 220*a*, 220*b*, 220*c*, 220*d*, 220*e*, and 220*f* of array 220 are illustrated as 16.

When switch 212 of FIG. 2*a* is closed or rendered conductive, the battery voltage is applied over path 214 (when pulsing device or coding block 216 is not used) and the bus connected to terminals 1 and 2 to the array of light sources 220. As mentioned, the light sources 220*a*, 220*b*, 220*c*, 220*d*, 220*e*, and 220*f* of array 220 are illustrated as being connected in parallel, so that energization is applied to each of the light sources 220*a*, 220*b*, 220*c*, 220*d*, 220*e*, and 220*f*. Since the voltage applied across each light source/current regulator is constant when the direct connection 214 is used, the light beams 16*a*, 16*b*, 16*c*, 16*d*, 16*e*, and 16*f* will remain constantly ON, so long as battery 210 continues to supply electrical energy.

If, in the arrangement of FIG. 2*a*, the direct connection 214 is not used, but instead the voltage is applied from battery 210 to light source array 220 by way of pulsing device 216, the pulsing device periodically makes and breaks the electrical connection between the battery 210 and the light source array 220 in a manner selected to create a visible pulsation of one or more of the light beams, or to encode the light beams with information by way of ON- and OFF-commands at a rate which is humanly perceptible.

Figure 2C:
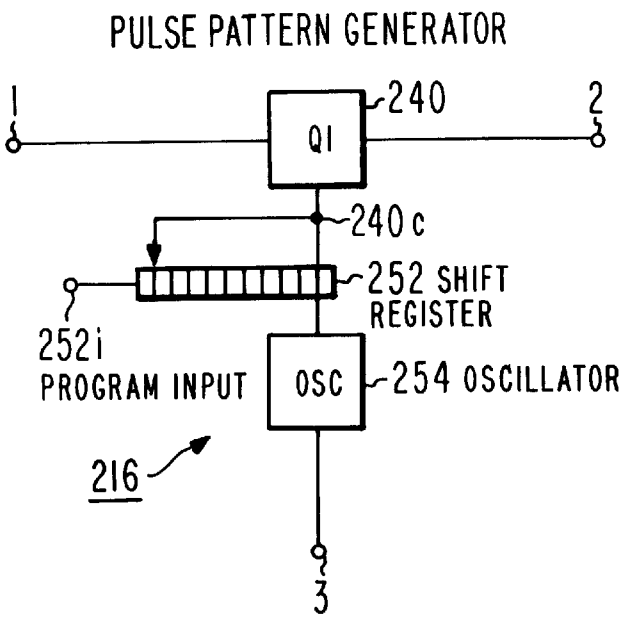
FIGS. 2*b* and 2*c* illustrate alternative forms of pulsing circuits which may be used in the arrangement of FIG. 2*a*.
Figure 2B:
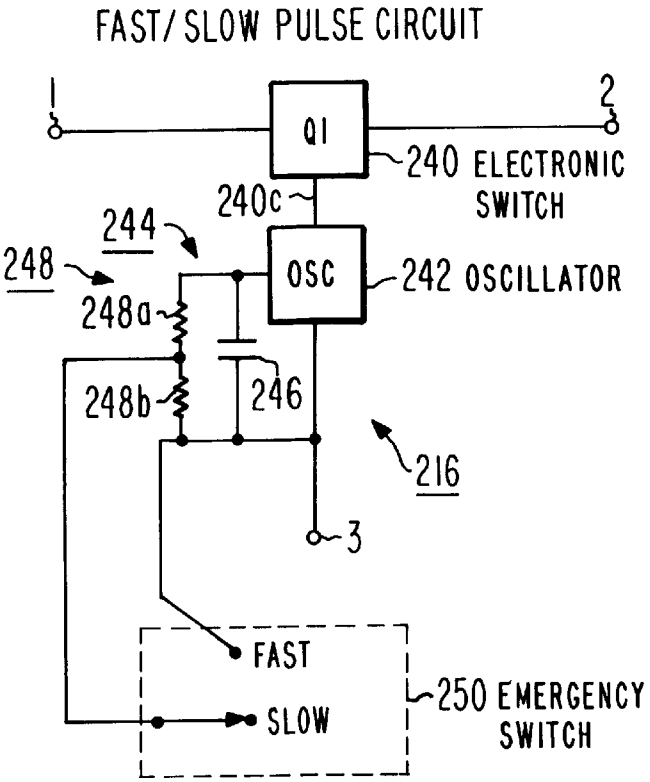

FIG. 2*b* is a simplified block diagram of a first pulsing device 216 which may be used in the arrangement of FIG. 2*a*. In FIG. 2*b*, terminals 1, 2, and 3 are connected to like-designated terminals of FIG. 2*a*. An electronic switch illustrated as a block 240 is coupled to receive the battery voltage at terminal 1, and to switch the battery voltage to terminal 2 under the control of a control signal applied to a control port 240*c* of switch 240. An oscillator 242 is connected to control port 240*c* of switch 240 and to terminal 3. Oscillator 242 generates control signals at control port 240*c* at a frequency established by a frequency control feedback arrangement 244. Frequency control arrangement 244 includes a capacitor 246 and a resisive network 248. Resistive network 248 includes a first resistor 248*a* in series with a second resistor 248*b*. A FAST-SLOW switch 250 is connected across resistor 248*b*, for reducing the resistance of resistive network 248 during those times in which the switch 250 makes contact, in which case resistor 248*b* is shorted, thereby reducing the resistance of resistive network 248 and increasing the frequency of oscillator 242. Thus, when FAST_SLOW switch 250 is in the illustrated SLOW, non-conductive state, resistor 248*b* is not shorted, and resistive network 248 is in its high-resistance state, giving the oscillator 242 high-frequency operation. This high-frequency operation, in turn, results in pulsation of switch 240 at a high rate, and when switch 250 is in its alternate (not illustrated) state, resistor 248*b* is shorted, the resistance of resistive network 248 is low, oscillator 242 oscillates at a low rate, and switch 240 switches at a low rate. While two rates are described for the multiple-rate embodiment of FIG. 2*b*, more than two rates could be used, so long as the rates were visible and distinguishable from each other.

FIG. 2*c* is a simplified block diagram of another embodiment of a pulsing device 216 which may be used in the arrangement of FIG. 2*a*, to provide pulse pattern encoding. In FIG. 2*c*, an electronic switch 240 is connected between terminals 1 and 2 for providing controllable conduction between those terminals, under the control of control signal applied to a control input port 240*c*. A recirculating shift register 252 continuously recirculates the same preprogrammed code to the control port 240*c* of the electronic switch 240 under control of an oscillator 254. A program input port 252*i* allows the program of the shift register 252 to be set. Recirculation of the code through the shift register at the frequency of clock 254 results in recurrent transmission of the same coding of the light beams. As illustrated in FIG. 2*c*, the oscillator 254 operates at a fixed clock frequency. If fitted with a swichable feedback arrangement such as 244 of FIG. 2*b*, the rate at which the code recirculates through shift register 252 and controls the light beams.

Figures 2D, 2E, 2F, 2G, 2H, 2I, 2J:
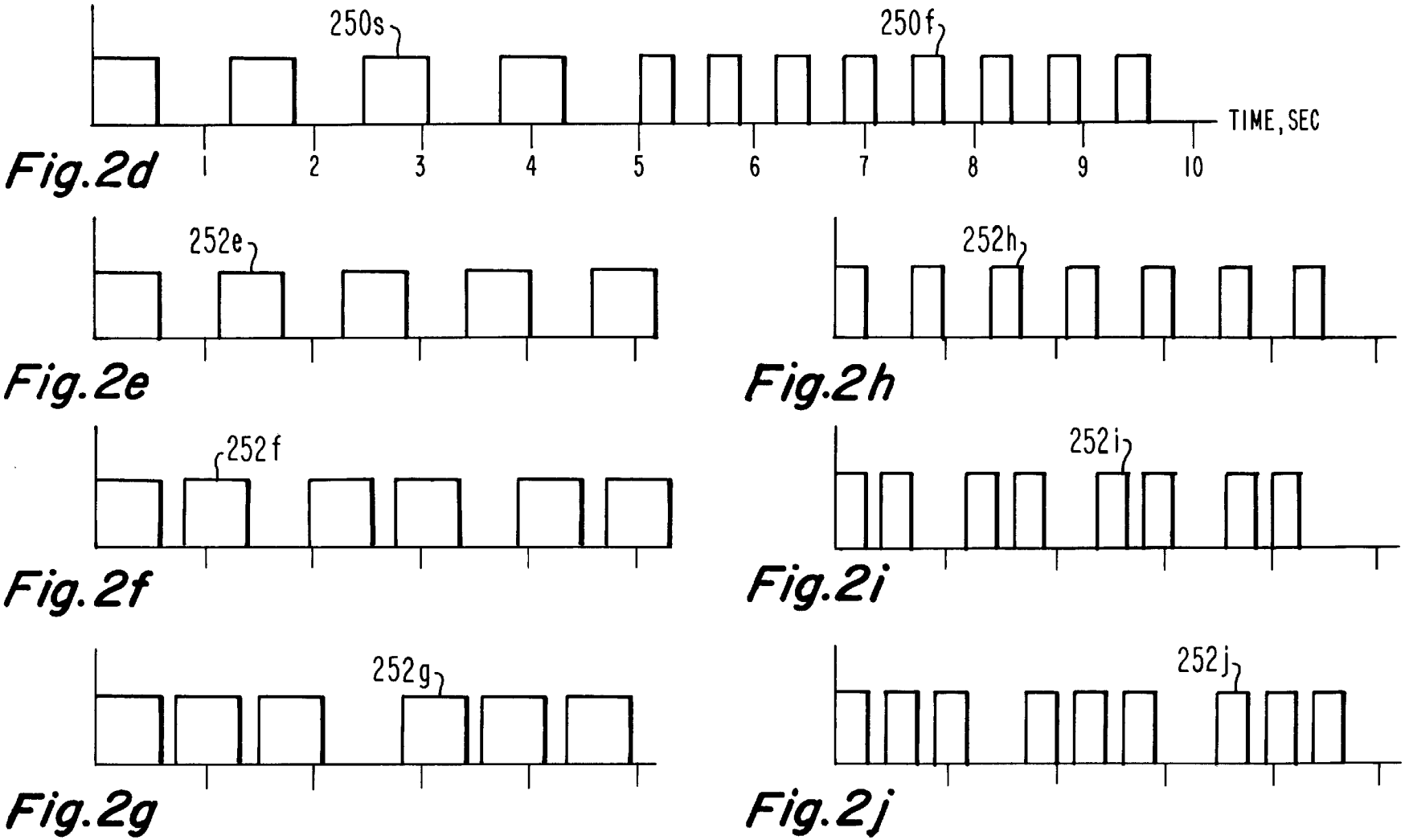
FIG. 2*d* represents coding with fast and slow pulses.
FIGS. 2*e*, 2*f*, 2*g*, 2*h*, 2*i*, and 2*j* are amplitude-time plots of possible codes.

Plots 250*s* and 250*d* of FIG. 2*d* represent the ON-OFF state of the light sources of the arrangement of FIG. 2*a* under the control of the FAST/SLOW switch arrangement of FIG. 2*c*. In plot 250*s*, slow ON-OFF pulses occur in the interval from zero seconds to five seconds with roughly half-second ON-times and half-second OFF times (one pulse per second or PPS). Following the 5-second point of FIG. 2*d*, fast ON/OFF pulses occur, having roughly two pulses per second. Light pulses having rates in the range of one pulse per second to a few pulses per second are highly visible. The slow pulses might be used to designate ordinary operation, while the two pulse-per-second rate could be used to indicate an emergency condition.

Plots 252*e*, 252*f*, and 252*g* of FIGS. 2*e*, 2*f*, and 2*g*, respectively, represent ON/OFF light modulation or coding which may be used to represent particular numbered, in this case the numbers one, two, and three, respectively. ON pulses in FIGS. 2*e*, 2*f*, and 2*g* are produced at a rate of one pulse per second, separated by extended OFF periods of one to one-and-a-half seconds to provide reference or starting/ending times. More particularly, in FIG. 2*e*, plot 252*e* has single ON-periods separated by reference long OFF-periods, to thereby identify the number to be represented as the number one. In FIG. 2*f*, plot 252*f* has pairs of two ON-periods separated by reference long OFF-periods, with the two ON-periods of each pair separated by a short interval, to thereby identify the number to be represented as the number two. Similarly, in FIG. 2*g*, plot 252*g* has triplets of three ON-periods separated by reference long OFF-periods, with the three ON-periods of each triplet separated by short intervals, to thereby identify the number to be represented as the number three. Naturally, other numbers may be indicated by a corresponding number of ON-pulses. This numbers one, two and three are represented in FIGS. 2*e*, 2*f*, and 2*g* by codes similar to the Morse code letters T, M, and O. Such coding may be produced by the shift-register arrangement of FIG. 2*c*.

Plots 252*e*, 252*f*, and 252*g* of FIGS. 2*e*, 2*f*, and 2*g* represent ON-OFF light modulation which is the combined function of slow or normal rate pulsing as shown in plot 250*s* of FIG. 2*d* and preprogrammed numerical coding. Plots 252*h*, 252*i*, and 252*j* of FIGS. 2*h*, 2*i*, and 2*j*, represent ON-OFF light modulation or coding which is the combined function of FAST or emergency rate pulsing as shown in plot 250*f* of FIG. 2*d* together with preprogrammed numeric coding. The circuitry of FIGS. 2*b* and 2*c* is combined to provide both preprogrammed codes under the control of a recirculating shift register and multiple repetition rates generated by a clock oscillator controlled by an operator-actuated emergency switch. This would, in effect, change the repetition rate of the code patterns from about one pulse per second (PPS) to about two pulses per second.

An example of a function embodied with the use of a pattern of ON and Off pulses of light would be: member one of a three-man emergency response team would wear a device with all beams pulsating in unison with a sequence equivalent to the Morse code letter T, which is a continuously repeating patter of a single ON pulse separated by obviously-longer OFF periods, as illustrated in plot 252*e*. The device worn by the second member of the threeman team would emit light beams with a sequence equivalent to Morse code letter M, which is a continuously repeated group of two ON pulses separated by an obviously-longer OFF period, as in plot 252*f* of FIG. 2*f*. The device worn by the third member of the three-man team would emit light beams with a sequence equivalent to Morse code letter O, which is a continuously repeated group of three ON pulses separated by an obviously-longer OFF period, as in plot 252*g* of FIG. 2*g*. This encoding would be previously programmed into each device using genarally available electronic circuitry.

An example of manually selected encoding of the light beams which would be embodied into the device and selected with a user operated emergency switch would be two different pulse rates designated as slow and fast. The meaning of the two different pulse rates would be predetermined by the team members prior to entering an emergency situation. One such use could be a signal for assistance by one of the team members (he would switch to fast pulse rate if help is needed).

Figure 3:
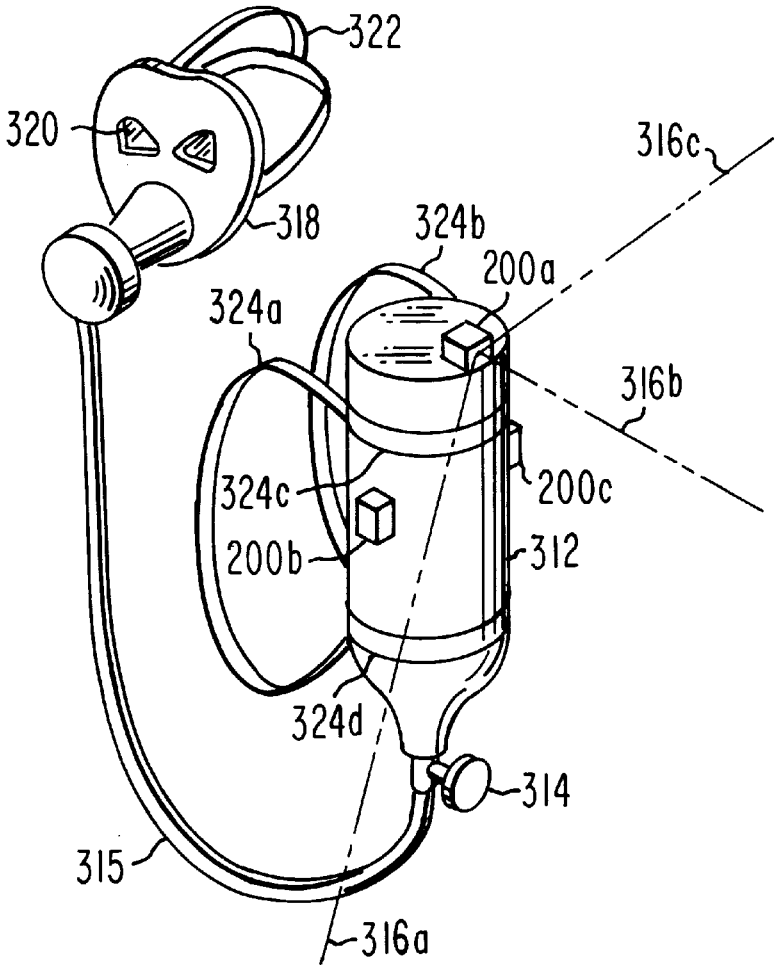
FIG. 3 is a simplified illustration of a donnable piece of equipment in accordance with an aspect of the invention.

FIG. 3 is a simplified illustration of a donnable piece of equipment 310 in accordance with an aspect of the invention. In FIG. 3, the arrangement 310 includes a tank 312 of a breathing apparatus for an emergency worker. Tank 312 has an outlet port with at least a valve 314, which allows the flow of air by way of an air hose 315 to an air mask 318, which includes transparent eye ports, one of which is illustrated as 320. Mask 318 is held on the wearer's head with the aid of straps illustrated as 322. Tank 312 is held on the wearer's body by shoulder straps 324*a* and 324*b*, which are affixed to tank straps illustrated as 324*c* and 324*d*. Boxes illustrated as 200*a*, 200*b*, and 200*c* represent three locations at which light beam generating arrangements such as 200 of FIG. 2*a* are, or may be affixed. Also illustrated in FIG. 3 are the paths 316*a*, 316*b*, and 316*c* taken by three of the light beams 16 produced by the arrangement 200 of FIG. 2*a*.

Figure 4:
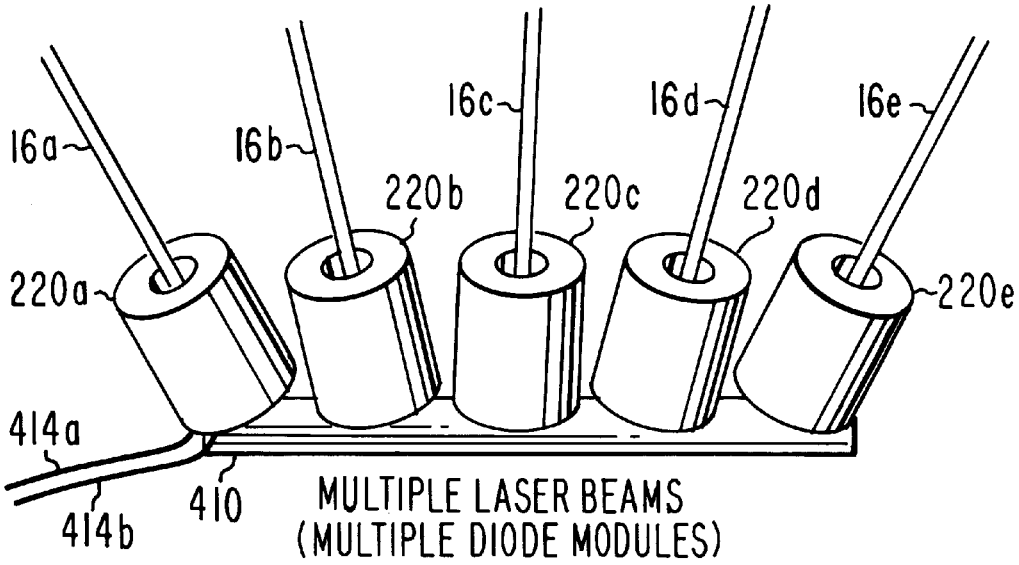
FIG. 4 illustrates a physical holder for an array of solid-state light sources which may be used in the arrangement of FIGS. 2*a* and 3.

FIG. 4 illustrates a holder for a plurality of solid-state light sources in the form of laser diode assemblies. In FIG. 4, holder 410 holds each of laser diodes 220*a*, 220*b*, 220*c*, 220*d*, and 220*e* at their bases, with the axes of their respective light beams 16*a*, 16*b*, 16*c*, 16*d*, and 16*e* axes skewed from each other. Lasers may well not need collimating lenses, because their beams are relatively narrow, while other types of light sources may require collimating lenses. Laser light sources may require dispersing lenses in order to make the beams wider to enhance their visibility. FIG. 4 also illustrates electrical connection wires 414*a* and 414*b*, by which electrical power is supplied to the various laser diodes.

Figure 5:
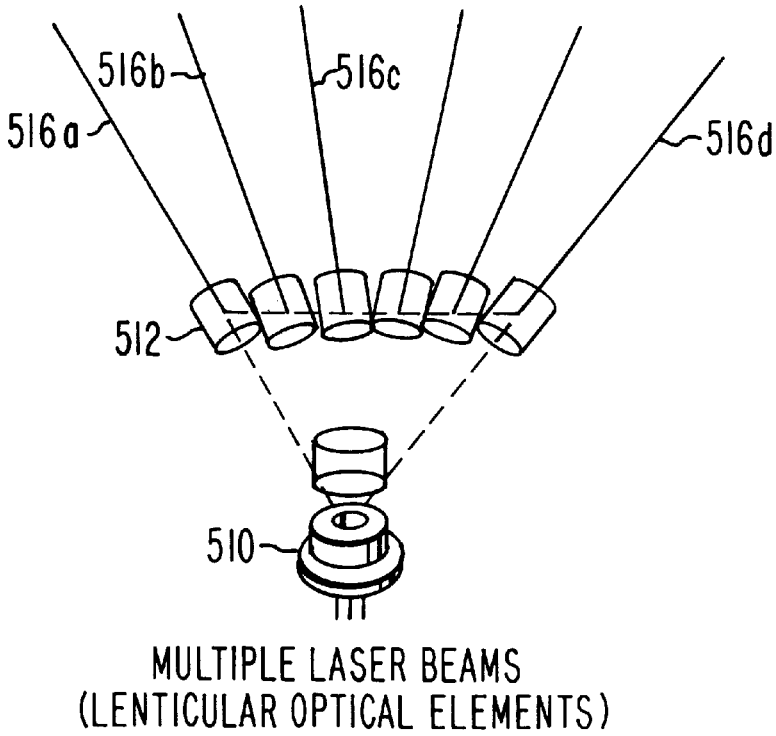
FIG. 5 illustrates a holder for multiple light sources.

FIG. 5 illustrates a single laser diode 510 with a lenticular optical array or arrangement 512, which as known to those skilled in the art, can convert a single light beam 514 into multiple, mutually dispersed light beams 516*a*, 516*b*, 516*c*, . . . , 516*d*. Some or all of the light sources of FIGS. 2 and 4 may use such lenticular arrays.

Figure 6:
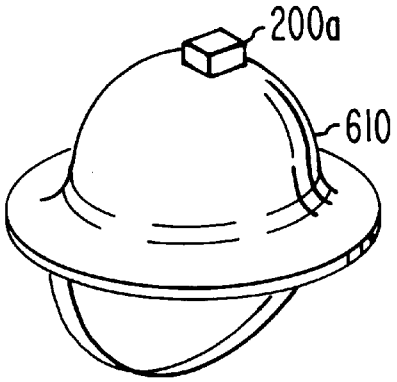
FIG. 6 illustrates a hat according to an aspect of the invention.

FIG. 6 illustrates a garment in the form of a hat 610 with a strap 612 and a source 220 mounted atop the hat.

Other embodiments of the invention will be apparent to those skilled in the art. For example, while solid-state light sources have been described, suitably small, bright and reliable filament-type lamps, or other light sources, could be used. While parallel connection of multiple light sources to the voltage source has been illustrated, series or series-parallel connections alone may be used, if appropriate. While a single battery has been illustrated and described, multiple batteries may be used, connected in series, parallel, or series-parallel. While the use of visible light has been described, there may be some situations, such as where infrared-type night vision viewers are used, in which infrared light beams, as for example in the range of 710 to 1100 nm, would become visible.

In an underwater context, blue-green or yellow-green light in the range of 500 to 575 nm, generated by frequency-doubling lasers, might be more visible than red or white. Manually selected coding and preprogrammed patterns of pulses may be embodied concurrently. This combined functionality would allow both the coding of individual devices (units one, two, three) and emergency state signaling (fast/slow pulses) to be utilized by each worker at the same time.

Thus, a method according to the invention for protecting emergency personnel includes the step of affixing to each emergency worker at least one source (200*a*; 220*a*, 220*b*, 220*c*, 220*d*, 220*e*, 220*f*) of multiple, mutually diverging, preferably collimated, light beams (16*a*, 16*b*, 16*c*, 16*d*, 16*e*, and 16*f*). These light beams (16*a*, 16*b*, 16*c*, 16*d*, 16*e*, and 16*f*) perforce diverge away from the emergency worker (10). The worker (10) also bears a source of energization (210) which is electrically coupled (by way of path 214 or pulsing device block 216) to the source (220*a*, 220*b*, 220*c*, 220*d*, 220*e*, 220*f*) of multiple beams (16*a*, 16*b*, 16*c*, 16*d*, 16*e*, and 16*f*) of light. Before the emergency worker (10) enters an emergency location, the source (220*a*, 220*b*, 220*c*, 220*d*, 220*e*, 220*f*) of multiple beams (16*a*, 16*b*, 16*c*, 16*d*, 16*e*, and 16*f*) of light is connected to the source of energization (210), for thereby generating the multiple beams (16*a*, 16*b*, 16*c*, 16*d*, 16*e*, and 16*f*) of light. In the event that the emergency worker (10) becomes incapacitated, his location can be established as being at the confluence or intersection of the diverging beams (16*a*, 16*b*, 16*c*, 16*d*, 16*e*, and 16*f*) of light. The beams of light, and their confluence, are especially visible in a smoky or hazy atmosphere. The step of connecting the source (210) may include the step of connecting the source (220*a*, 220*b*, 220*c*, 220*d*, 220*e*, 220*f*) of multiple beams (16*a*, 16*b*, 16*c*, 16*d*, 16*e*, and 16*f*) of light to the source of energization (210) by way of an automatic pulse generating arrangement (216), for energizing (ON) and deenergizing (OFF) at least a portion of the source (220) of multiple beams (16), for thereby causing at least one of the multiple beams (16*a*, 16*b*, 16*c*, 16*d*, 16*e*, and 16*f*) to visibly pulsate. The pulsation makes the beam easier to see. According to another aspect of the invention, the step of connecting the source includes the step of connecting the source (220*a*, 220*b*, 220*c*, 220*d*, 220*e*, 220*f*) of multiple beams (16*a*, 16*b*, 16*c*, 16*d*, 16*e*, and 16*f*) of light to the source of energization (210) by way of an automatic pulse generating arrangement (216), for sequentially energizing and deenergizing at least a portion of the source (220*a*, 220*b*, 220*c*, 220*d*, 220*e*, 220*f*) of multiple beams (16*a*, 16*b*, 16*c*, 16*d*, 16*e*, and 16*f*) of light, for thereby causing at least one of the multiple beams to pulsate.

In a preferred embodiment of the invention, the step of connecting the source (220*a*, 220*b*, 220*c*, 220*d*, 220*e*, 220*f*) of multiple beams (16*a*, 16*b*, 16*c*, 16*d*, 16*e*, and 16*f*) of light to the source (210) of energization (210) by way of an automatic pulse generating arrangement (216) includes the step of connecting the source (220*a*, 220*b*, 220*c*, 220*d*, 220*e*, 220*f*) of multiple beams of light (16*a*, 16*b*, 16*c*, 16*d*, 16*e*, and 16*f*) to the source of energization (210) by way of an automatic pulse generating arrangement (216) which sequentially energizes (ON) and deenergizes (OFF) that portion of the source of multiple beams in a fashion which modulates at least one of the multiple beams with one of a first selected code (250*s*; and any of codes 252*e*, 252*f*, and 252*g*) and a second selected code (250*f*; and any one of codes 252*h*, 252*i*, and 252*j*). Each code (252*e*, 252*f*, 252*g*) can thus be transmitted at a first selected rate (250*s*) or at a second selected rate (250*f*). Plots 252*e*, 252*f*, 252*g*, 252*h*, 252*i*, and 252*j* of FIGS. 2*e*, 2*f*, 2*g*, 2*h*, 2*i*, and 2*j*, respectively, show the combined effects of the rates of codes 250*s* and 250*f*. This allows the person or emergency worker (10) bearing the source (200) of multiple beams (16*a*, 16*b*, 16*c*, 16*d*, 16*e*, and 16*f*) to, after entering the emergency location, changing (with switch 242) the one of the codes to the other one of the codes (250*f*), to thereby transmit over the at least one (and preferably all) of the light beams an indication of a change in the state of the emergency worker.

The step of affixing to each emergency worker a source of multiple beams of light may include the step of affixing a holder (410) for multiple lasers (220*a*, 220*b*, 220*c*, . . . ,) to an article (610) capable of being worn by the emergency worker, such as a protective garment, helmet, or breathing apparatus, preferably an article which cannot easily be easily dislodged by a fall. A source of energization (210) is also affixed to the article (610) capable of being worn, or possibly to some other donnable article; the source of energization (210) is preferably mounted in the same housing (200*a*) as the laser (220) holder (410). The emergency worker is then caused to don the article capable of being worn, and the multiple lasers are electrically connected to the source of energization, either by an interconnecting wire or by a switch (212).

An apparatus for aiding in performing the method of the invention includes a donnable article of apparel (310, 610), an electrically actuated source (220) of mutually diverging beams (16) of preferably collimated light mounted on the article of apparel (310, 610), with the light beams directed outwardly (away from the wearer), a source of electrical energy (210) mounted on the article of apparel (200, 310, 610), and an electrical connection arrangement (212, 214, 216) coupled to the source of mutually diverging beams (220) and the source of electrical energy (210), for electrically connecting the source (220) of mutually diverging beams (16) to the source of electrical energy (210) in a manner which results in electrical energization of the source (220) of mutually diverging beams (16). The electrical connection arrangement (212, 214, 216) preferably includes a manually operated switch (212), and a coding arrangement (216) for imparting a selectable one of a plurality of codes (250, 252) to electricity traversing the electrical connection arrangement, for thereby imparting one of the plurality of codes to the mutually diverging beams. The apparatus should also include an emergency button or switch (242) which is operable by the emergency worker to cause the code to change (from slow to fast, for example) in the event of a personal emergency of that worker.

What is claimed is:

1. A method for protecting emergency personnel, said method comprising the steps of:

affixing to each emergency worker a source of multiple beams of collimated, visible light, said beams diverging away from said emergency worker in various directions, and a source of energization coupled to said source of multiple beams of light; and before said emergency worker enters an emergency location, connecting said source of multiple beams of light to said source of energization, for thereby generating said multiple beams of light, whereby in the event that said emergency worker becomes incapacitated, his location can be established as being at the confluence of said diverging beams of light.

2. A method according to claim 1, wherein said step of affixing to each emergency worker includes the step of affixing to each emergency worker a source of multiple beams of visible light.

3. A method according to claim 2, wherein said step of connecting said source includes the step of connecting said source of multiple beams of light to said source of energization by way of an automatic pulse generating arrangement, for energizing and deenergizing at least a portion of said source of multiple beams, for thereby causing at least one of said multiple beams to pulsate.

4. A method according to claim 1, wherein said step of affixing to each emergency worker a source of multiple beams of light includes the step of affixing to each emergency worker a source of multiple beams of light in one of the infrared, red, blue-green, and yellow-green wavelength bands.

5. A method according to claim 1, wherein said step of connecting said source includes the step of connecting said source of multiple beams of light to said source of energization by way of an automatic pulse generating arrangement, for sequentially energizing and deenergizing at least a portion of said source of multiple beams, for thereby causing at least one of said multiple beams to pulsate.

6. A method according to claim 5, wherein said step of connecting said source of multiple beams of light to said source of energization by way of an automatic pulse generating arrangement includes the step of connecting said source of multiple beams of light to said source of energization by way of an automatic pulse generating arrangement which sequentially energizes and deenergizes said portion of said source of multiple beams in a fashion which modulates at least one of said multiple beams with one of a first selected code and a second selected code, neither of which codes is a continual illumination state.

7. A method according to claim 6, further comprising the step of, after entering said emergency location, changing said one of said codes to the other one of said codes, to thereby transmit over said at least one of said light beams an indication of a change in the state of said emergency worker.

8. A method according to claim 5, wherein said step of connecting said source of multiple beams of light to said source of energization by way of an automatic pulse generating arrangement includes the step of connecting said source of multiple beams of light to said source of energization by way of an automatic pulse generating arrangement which sequentially energizes and deenergizes said portion of said source of multiple beams in a fashion which modulates at least one of said multiple beams with one of a preselected code.

9. A method according to claim 1, wherein said step of affixing to each emergency worker a source of multiple beams of light includes the steps of:

affixing a holder for multiple lasers to an article capable of being worn by said emergency worker;

affixing a source of energization to said article capable of being worn;

causing said emergency worker to don said article capable of being worn; and electrically connecting said multiple lasers to said source of energization.

10. A method for protecting emergency personnel, said method comprising the steps of:

affixing to each emergency worker a source of multiple beams of light, said beams diverging away from said emergency worker in various directions, and a source of energization coupled to said source of multiple beams of light;

before said emergency worker enters an emergency location, connecting said source of multiple beams of light to said source of energization, by way of an automatic pulse generating arrangement which sequentially energizes and deenergizes said portion of said source of multiple beams in a fashion which modulates at least one of said multiple beams with one code of a preselected set of codes, for sequentially energizing and deenergizing at least a portion of said source of multiple beams, for thereby generating said multiple beams of light and causing at least one of said multiple beams to pulsate, whereby in the event that said emergency worker becomes incapacitated, his location can be established as being at the confluence of said diverging beams of light; and prior to entering said emergency location, one of programming and selecting said one of said codes to be unique for each one of said emergency workers at said emergency location, to thereby transmit over said at least one of said light beams a coded indication of the identity of said one of said emergency workers.

11. An apparatus comprising:

a donnable article of apparel;

an electrically actuated source of mutually diverging collimated beams of light mounted on said article of apparel, with said beams directed outwardly;

a source of electrical energy mounted on said article of apparel; and electrical connection means coupled to said source of mutually diverging collimated beams and said source of electrical energy, for electrically connecting said source of mutually diverging collimated beams to said source of electrical energy in a manner which results in electrical energization of said source of mutually collimated diverging beams for at least some time.

12. An apparatus according to claim 11, wherein said electrical connection means comprises a manually operable switch.

13. An apparatus according to claim 11, wherein said electrical connection means comprises coding means for imparting a selectable one of a plurality of non-continuous-connection codes to electricity traversing said electrical connection means, for thereby imparting said one of said plurality of codes to said mutually diverging beams.

* * * * *